US007473115B2

(12) United States Patent
Yu et al.

(10) Patent No.: US 7,473,115 B2
(45) Date of Patent: Jan. 6, 2009

(54) MEMORY CARD CONNECTOR WITH IMPROVED SWITCH STRUCTURE

(75) Inventors: Jian-Fei Yu, Kunshan (CN); Mao-Lin Lei, Kunshan (CN); Qi-Jun Zhao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/810,252

(22) Filed: Jun. 5, 2007

(65) Prior Publication Data

US 2007/0281525 A1 Dec. 6, 2007

(30) Foreign Application Priority Data

Jun. 5, 2006 (TW) ..... 95209724 U

(51) Int. Cl.
*H01R 29/00* (2006.01)

(52) U.S. Cl. ..... 439/188; 439/159

(58) Field of Classification Search ..... 439/159, 439/630, 188, 325, 262; 200/51.09, 51.1
See application file for complete search history.

(56) References Cited

U.S. PATENT DOCUMENTS 3,903,385 A * 9/1975 Moyer et al. ..... 200/51.1
5,352,128 A * 10/1994 Bricaud ..... 439/188
6,394,827 B2 5/2002 Nogami
6,648,694 B2 * 11/2003 Takamori et al. ..... 439/630

* cited by examiner

*Primary Examiner*—Edwin A Leon
(74) *Attorney, Agent, or Firm*—Wei Te Chung

(57) ABSTRACT

A memory card connector (100) for insertion of a memory card (8) includes an insulative housing (1) defining a cavity (110) for receiving the memory card, a number of contacts (22) with multiple contact portions (221) protruding into the card receiving cavity, a pair of switch contacts (5) and an elastic member (6). The elastic member includes a first spring (61) always abutting against one switch contact (51) and a second spring (62) driven by the inserted memory card to engage the other switch contact (52) in order to achieve switch function.

20 Claims, 9 Drawing Sheets

MEMORY CARD CONNECTOR WITH IMPROVED SWITCH STRUCTURE

BACKGROUND OF THE INVENTION

1. Field of the Invention

This invention generally relates to a memory card connector, and more particularly to a memory card connector with switch structure.

2. Description of the Prior Art

With development of electronic devices such as cellular phones, Personal Digital Assistants (PDA) and digital cameras, memory cards are used more and more popular wherein the memory cards include a number of types including Compact Flash (CF) card, Secure Digital (SD) card, Multimedia card (MMC), Subscriber Identity Module (SIM) card, Memory Stick (MS), Smart Media (SM) card, XD-picture (XD) Card and Trans Flash (TF card). The memory cards are inserted into corresponding card connectors for signal transmission between the memory cards and the electronic devices. Generally, a card connector sets a switch structure to detect whether corresponding card is inserted into the card connector or not.

U.S. Pat. No. 6,394,827 B2 discloses a conventional memory card connector for insertion of a memory card. The memory card connector comprises an insulative housing having a pair of side walls and a card receiving cavity between said side walls, a plurality of contacts retained in the insulative housing with a plurality of contact portions protruding into the card receiving cavity, a card eject mechanism for mating with the memory card, a pair of switch contacts and a metal shield enclosing the insulative housing. The switch contacts are disposed on one of the side walls and the card eject mechanism is positioned on the other side wall. The switch contacts include a stationary contact having a contact section and a movable contact having another contact section positioned on a lateral side of the contact section. The movable contact further includes an engaging section laterally extending into the card receiving cavity for abutting against the inserted memory card. When the memory card is inserted into the card receiving cavity, the engaging section is driven by the memory card to make the another contact section of the movable contact disengages from the contact section of the stationary contact. As a result, the switch function is realized. However, some memory card connector, such as TF card connector, is becoming smaller and smaller according to the development of corresponding memory card. In this condition, the memory card connector may can't provide enough width of side walls for switch contacts mounted thereon.

Hence, it is desired to have a memory card connector solving the problem above.

BRIEF SUMMARY OF THE INVENTION

Accordingly, an object of the present invention is to provide a memory card connector with flexible engagement to achieve detective function.

In order to attain the object above, a memory card connector for insertion of a memory card comprises an insulative housing defining a card receiving cavity, a plurality of contacts with a plurality of contact portions protruding into the card receiving cavity, a pair of switch contacts and an elastic member. The elastic member includes a first contact portion abutting against one switch contact and a coiled spring driven by the inserted memory card to engage the other switch contact in order to achieve switch function. The other switch contact can be prevented from excessive deformation through flexible engagement between the other switch contact and the coiled spring.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
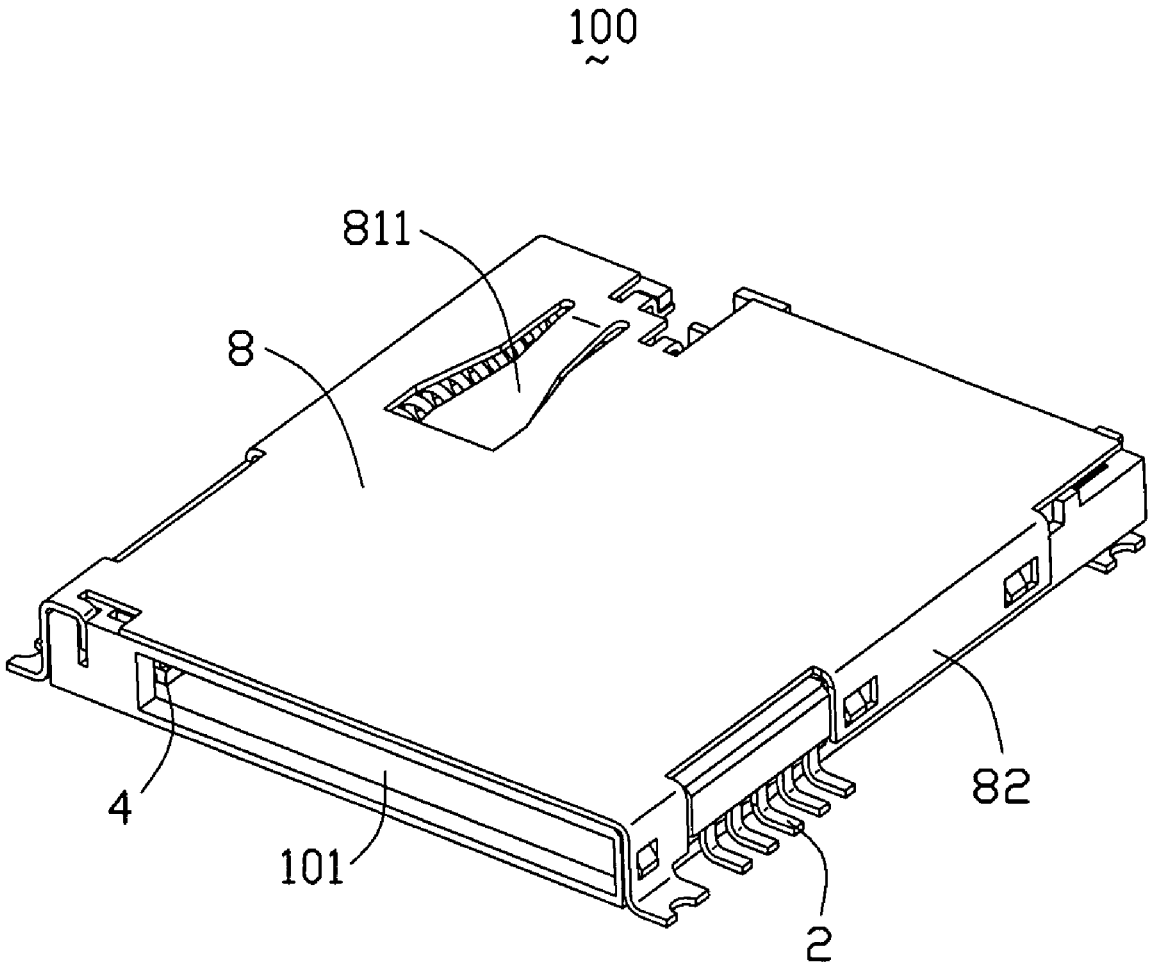
FIG. 1 is a front, perspective view of a memory card connector according to a preferred embodiment of the present invention.
Figure 2:
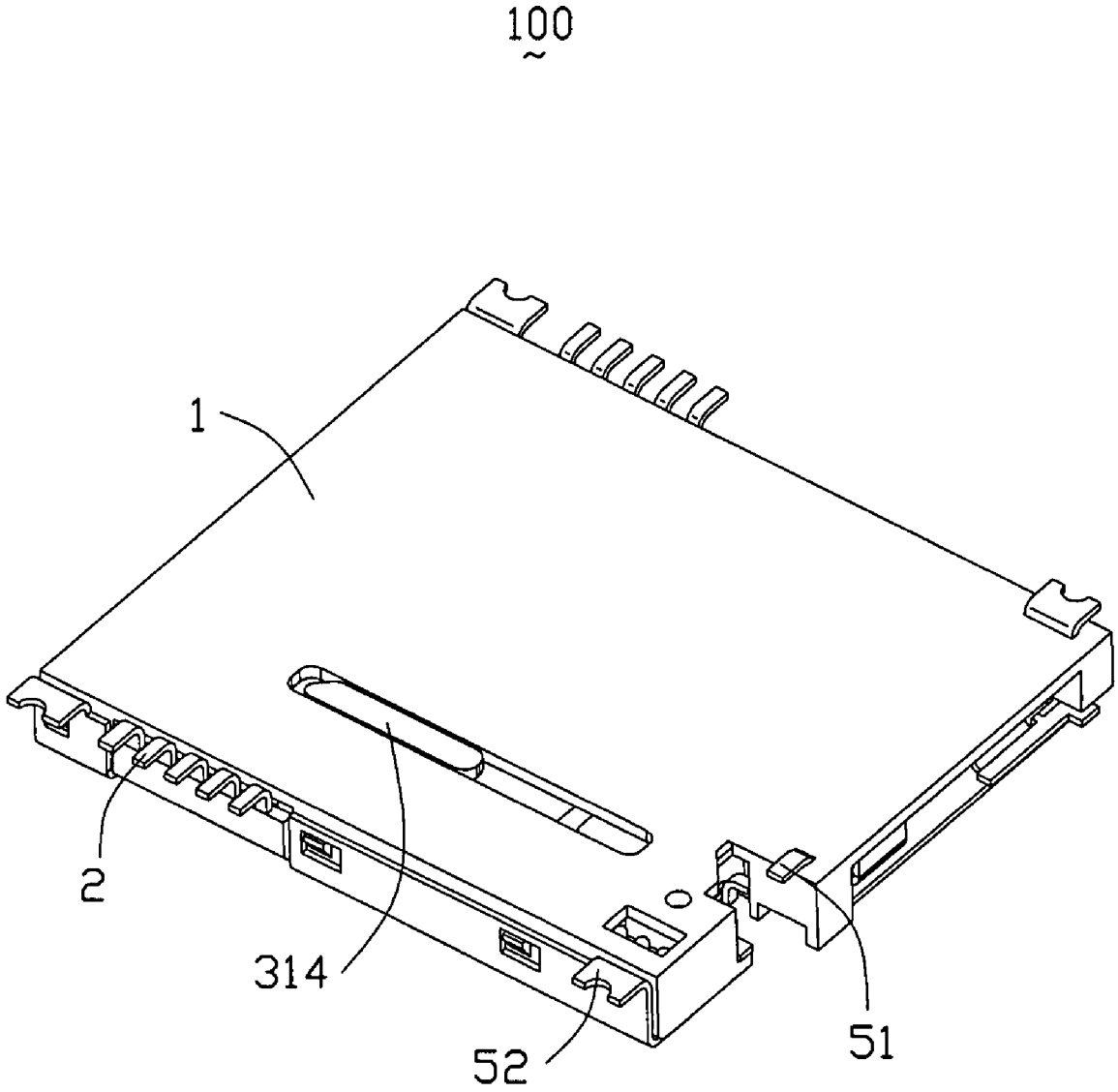
FIG. 2 is similar to FIG. 1, but viewed from another aspect.
Figure 3:
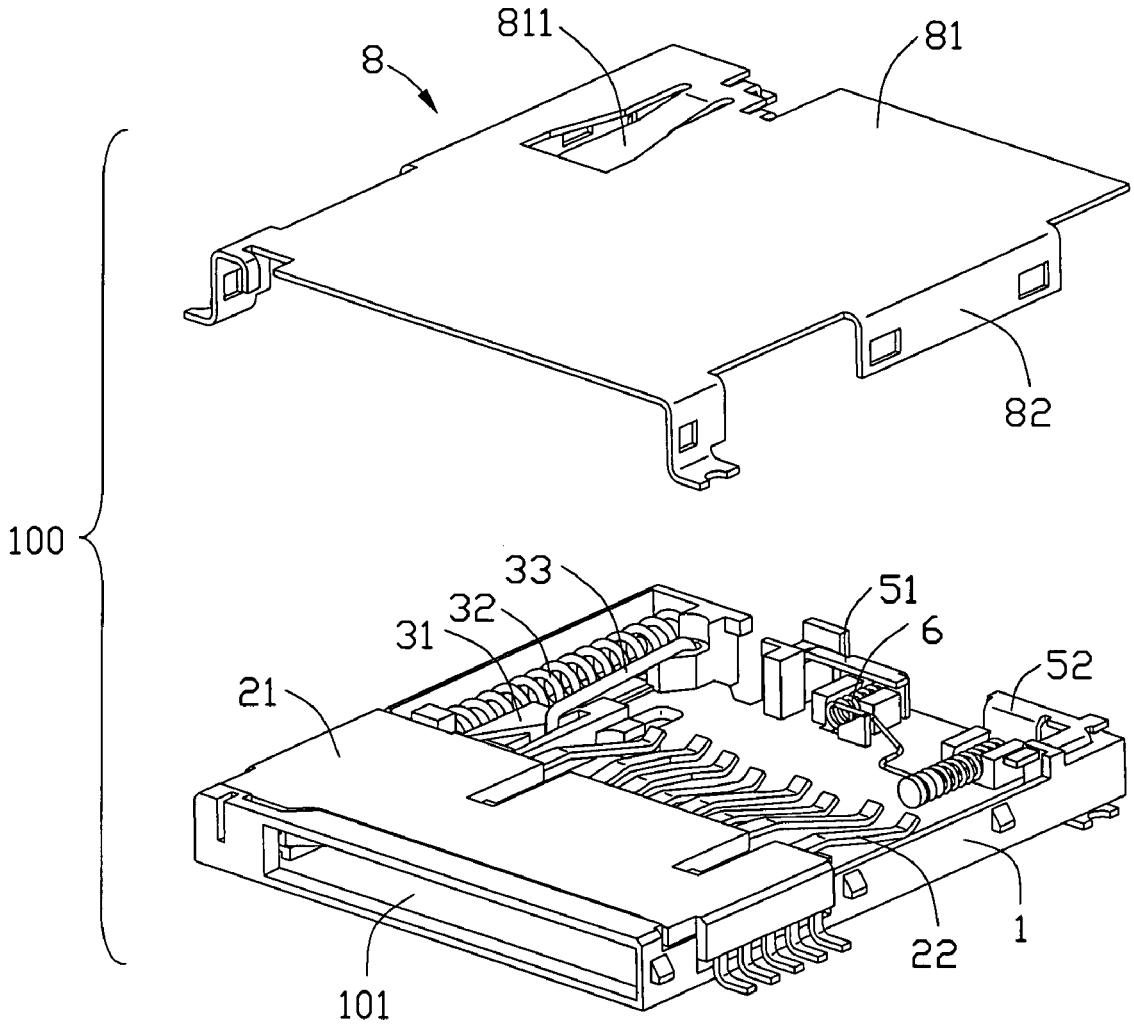
FIG. 3 is a partly exploded view of the memory card connector before a metal shield mounted thereon.
Figure 4:
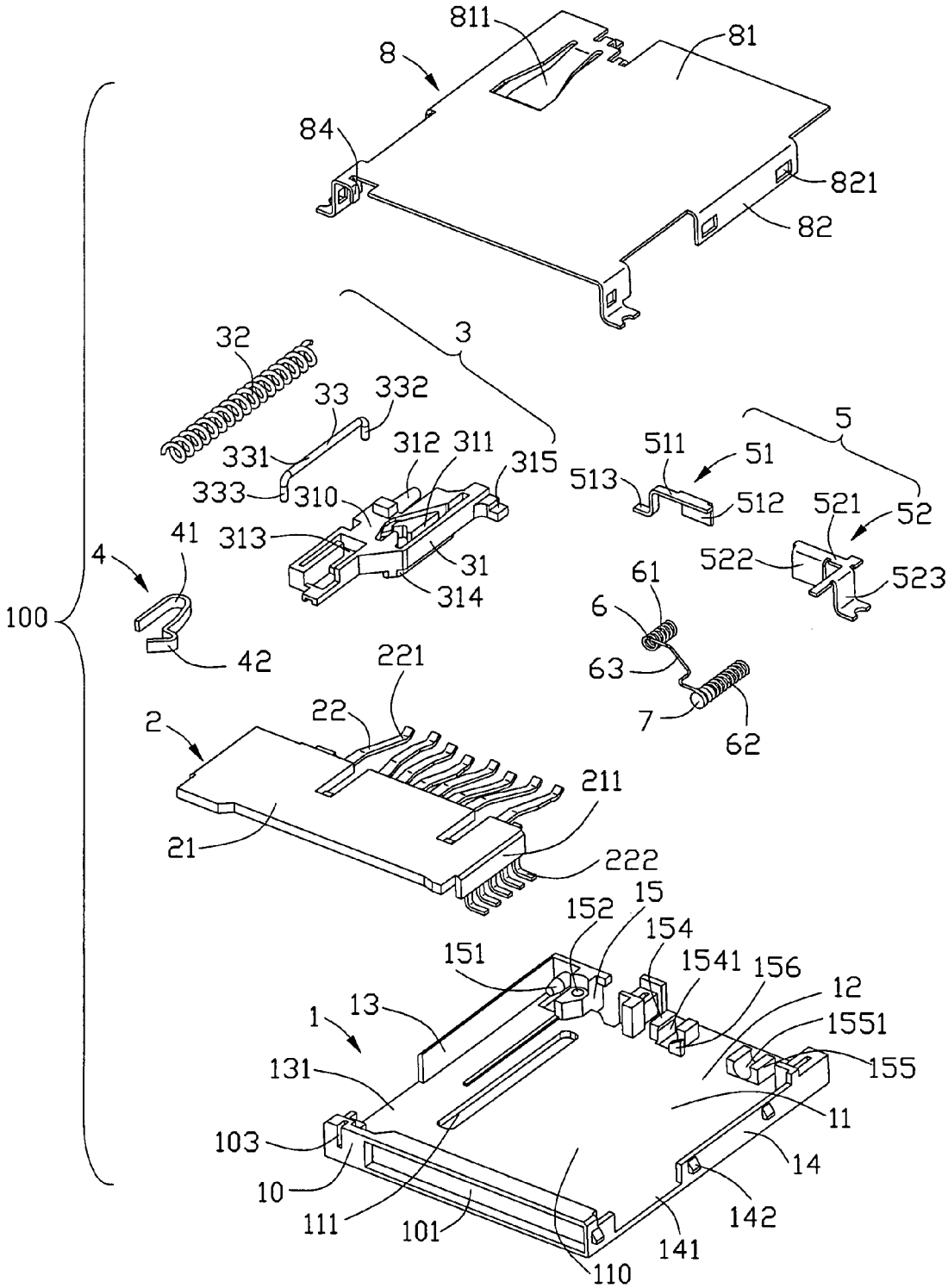
FIG. 4 is an exploded view of the memory card connector shown in FIG. 1.

Reference will now be made in detail to the preferred embodiment of the present invention.

Referring to FIGS. 1 to 4, a memory card connector 100 mounted on a PCB (shown in FIG. 8) for receiving a memory card 9 comprises an insulative housing 1, a contact module 2, a card eject mechanism 3, a card lock member 4, a pair of switch contacts 5 retained in the insulative housing 1, an elastic member 6 and a metal shield 8 enclosing the insulative housing 1.

The insulative housing 1 includes a base portion 11 and a frame shaped mating portion 10 at the front of the base portion 11. The base portion 11 defines a cavity 110 having an opening 101 which extends through the mating portion 10 and permits insertion and removal of the memory card 9 into and out of the cavity 110. The mating portion 10 includes a narrow slot 103 positioned on a lateral side of the opening 101 for retaining the metal shield 8. The base portion 11 includes a top wall 12, opposite first and second side walls 13, 14 and a discontinuous rear wall 15 opposite to the mating portion 10. The top wall 12 defines a front-to-back guiding slot 111 for guiding movement of the card eject mechanism 3. The first and second side walls 13, 14 define opposite first and second cutouts 131, 141, respectively, for mating with the contact module 2. The rear wall 15 defines a first projecting block 154 and a second projecting block 155 apart in a direction perpendicular to the front-to-back direction. The first and second projecting blocks 154, 155 define first and second apertures 1541, 1551, respectively, for receiving the elastic member 6.

The contact module 2 comprises a plurality of contacts 22 and a beam 21 over-molding the contacts 22. The beam 21 includes a pair of side portions 211 received in the first and second cutouts 131, 141, respectively. The contacts 22 include a plurality of contact portions 221 extending into the cavity 110 for electrically mating with the memory card 9 and a plurality of soldering portions 222 extending sidewardly beyond the side portions 221 to be soldered to the PCB.

The card eject mechanism 3 comprises a slider 31, a coiled spring 32 and a link rod 33. The slider 31 includes a body portion 310 and an actuation portion 315 extending laterally from a front side of the body portion 310. The body portion 310 includes a heart-shaped cam 311 recessed in a top face thereof and a projecting 314 extending downwardly from a bottom face of the body portion 310. The projecting 314 is movably received in the guiding slot 111 to make sure that the slider 31 moves along the front-to-back direction. Besides, a U-shaped recess 313 is defined in the body portion 310 of the slider 31 to retain the card lock member 4.

The coiled spring 32 gives the slider 31 elastic force to realize ejecting the memory card 9 from the memory card connector 100. In order to fix the coiled spring 32 in the memory card connector 100, the rear wall 15 of the insulative housing 1 and the slider 31 include first and second fixing posts 151, 312, respectively. The coiled spring 32 is assembled between the first and second fixing posts 151,312.

The link rod 33 includes a middle portion 331, a first hook 332 and a second hook 333 downwardly bending from opposite ends of the middle portion 331. The first hook 332 is inserted into a mounting hole 152 of the insulative housing 1 for retaining purpose. The second hook 333 can move in the heart-shaped cam 311. The working theory of the card eject mechanism 3 is obvious to the people in the art, so the detailed description is omitted hereinafter.

The card lock member 4 is received in the U-shaped recess 313 of the slider 31 and comprises a stationary portion 41 and a locking portion 42 at a distal end of the stationary portion 41. The locking portion 42 protrudes into the cavity 110 for holding the memory card 9 when it is inserted into the memory card connector 100.

Figure 5:
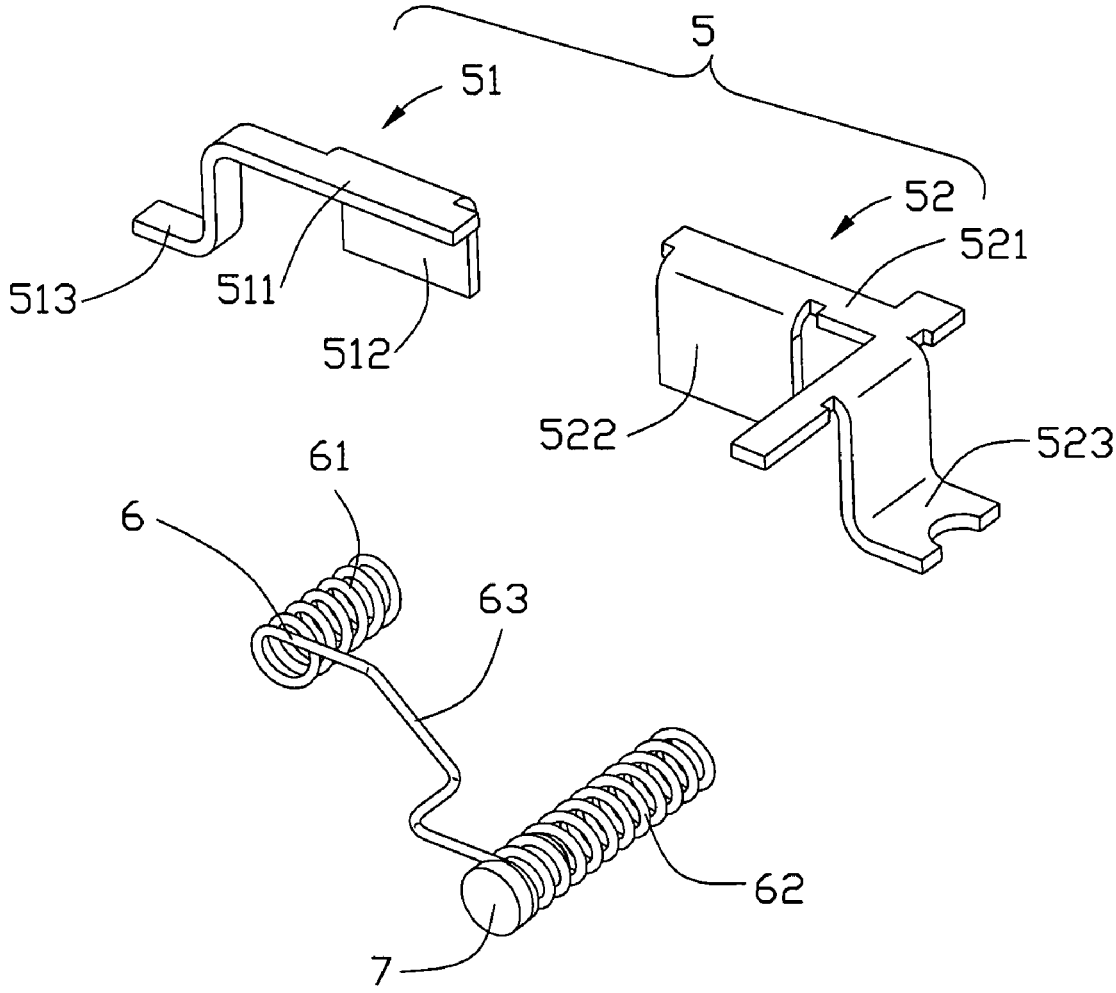
FIG. 5 is an enlarged, perspective view showing a pair of switch contacts, an elastic member and a mating block inserted into the elastic member.
Figure 6:
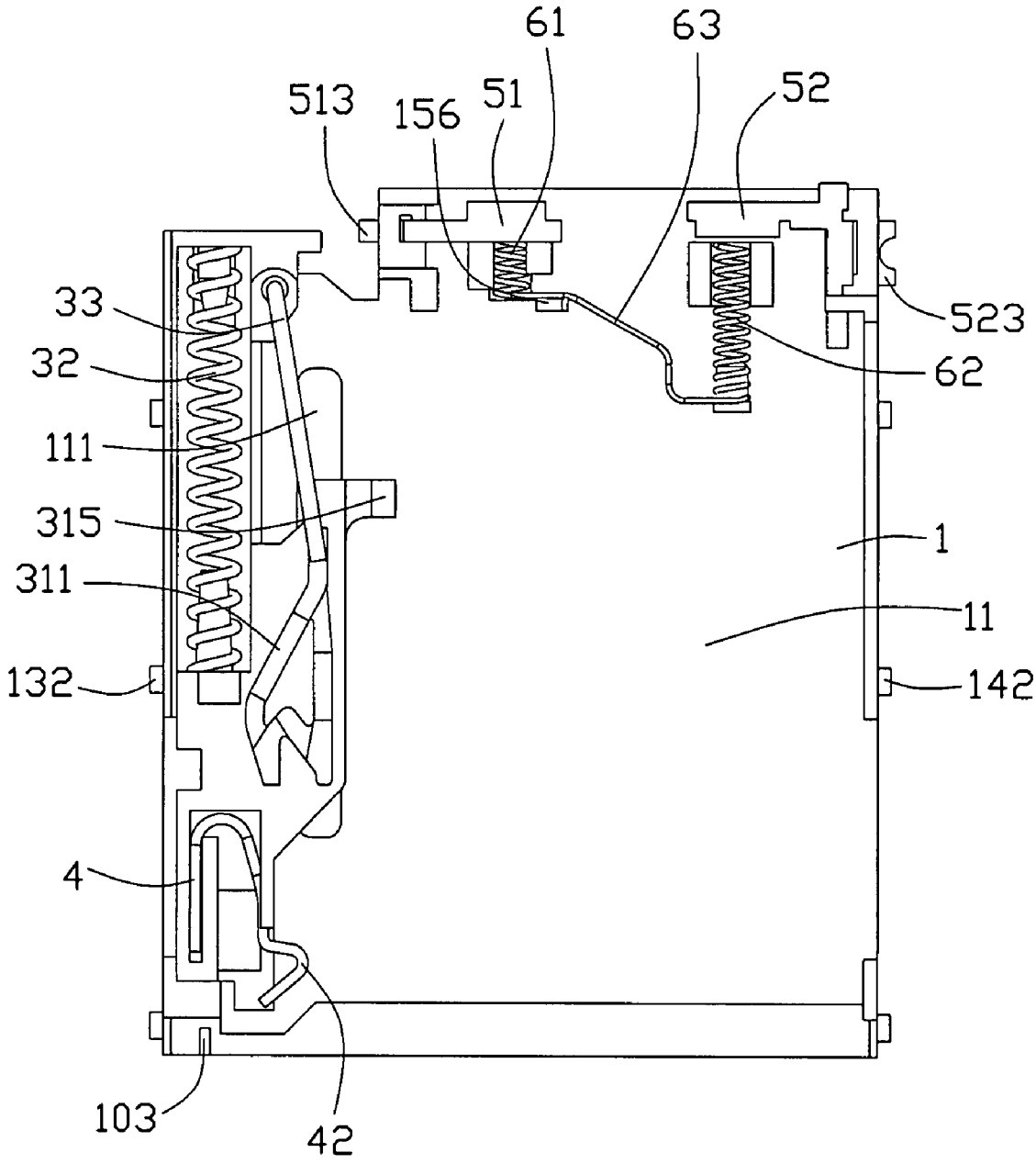
FIG. 6 is a top view of the partly assembled memory card connector without a contact module and a metal shield mounted thereon.
Figure 7:
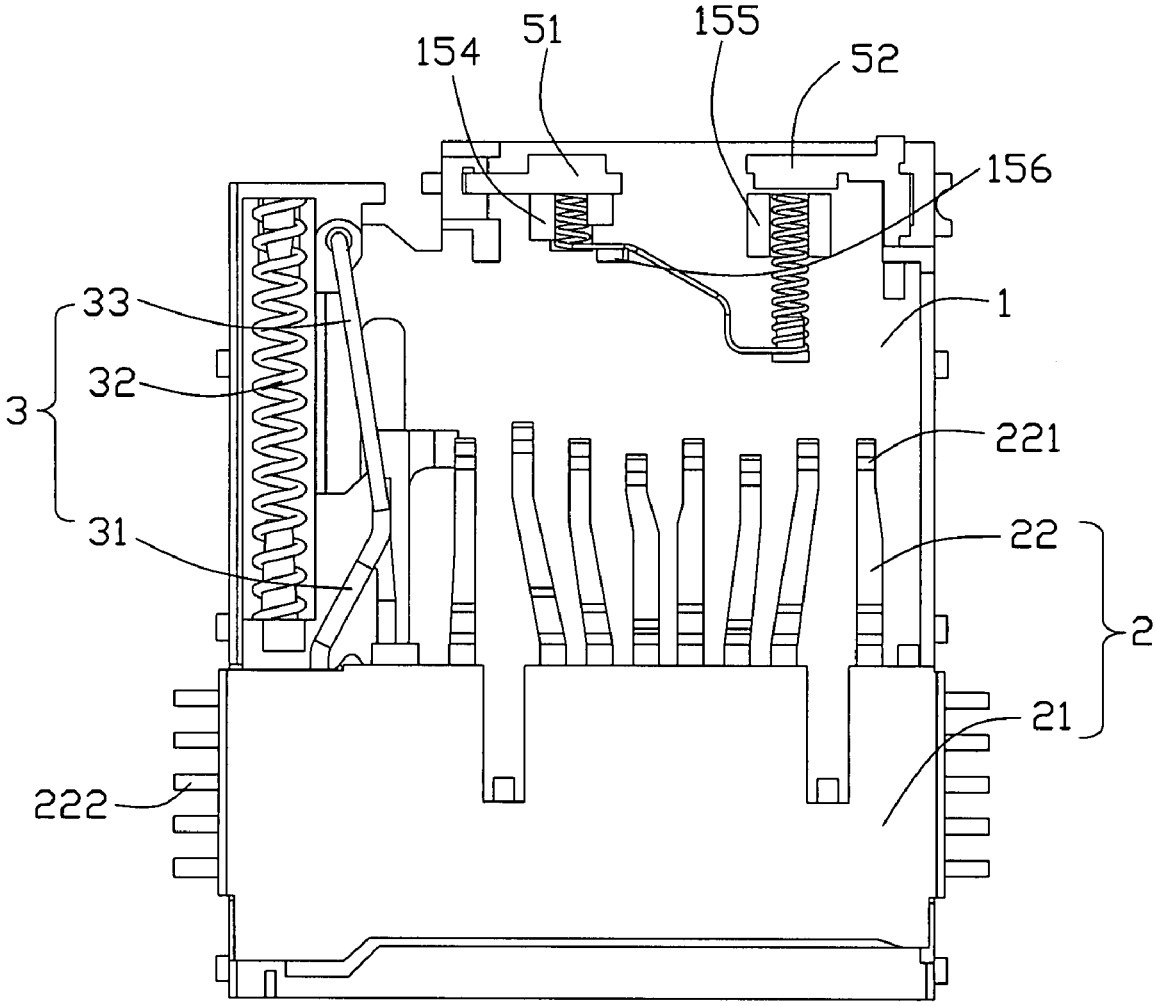
FIG. 7 is a top view of the partly assembled memory card connector with the contact module mounted thereon.

Referring to FIGS. 5-7, the pair of switch contacts 5 include a first switch contact 51 and a second switch contact 52. The first switch contact 51 includes a first base 511, a first contact section 512 bending from a rear edge of the first base 511 and a first soldering tail 513. The second switch contact 52 includes a second base 521, a second contact portion 522 bending from a front edge of the second base 521 and a second soldering tail 523. The first and second contact sections 512, 522 are positioned in vertical planes.

The elastic member 6 is made of conductive materials and comprises a first contact portion 61 always connecting the first contact section 512 of the first switch contact 51, a second contact portion 62 detachably engaging with the second contact section 522 of the second switch contact 52 and a connecting portion 63 connecting with the first and second contact portions 61, 62. The first and second contact portions 61, 62 are both coiled springs and received in the first and second apertures 1541, 1551, wherein the first contact portion 61 is parallel to the second contact portion in the front-to-back direction. In order to ensure the first contact portion 61 always abutting against the first switch contact 51, an engagement block 156 is positioned on the insulative housing 1 for engaging with the connecting portion 63. Besides, the memory card connector 100 further includes a mating block 7 inserted into the second contact portion 62 to increase contact face for mating with the memory card 9.

The metal shield 8 includes a top wall 81 and a pair of side walls 82 bending from lateral edges of the top wall 81. The top wall 81 includes a tab 84 formed at the front edge thereof to be received in the corresponding narrow slot 103 of the mating portion 10 of the insulative housing 1. The top wall 81 includes an inward cantilever 811 for pressing the middle portion 331 of the link rod 33 to prevent it from falling out. Besides, the side walls 82 define a plurality of holes 821 and the first and second side walls 13, 14 of the insulative housing include a plurality of corresponding protrusions 132, 142 received in the holes 621 so that the metal shield 8 can be stably attached to the insulative housing 1.

Figure 8:
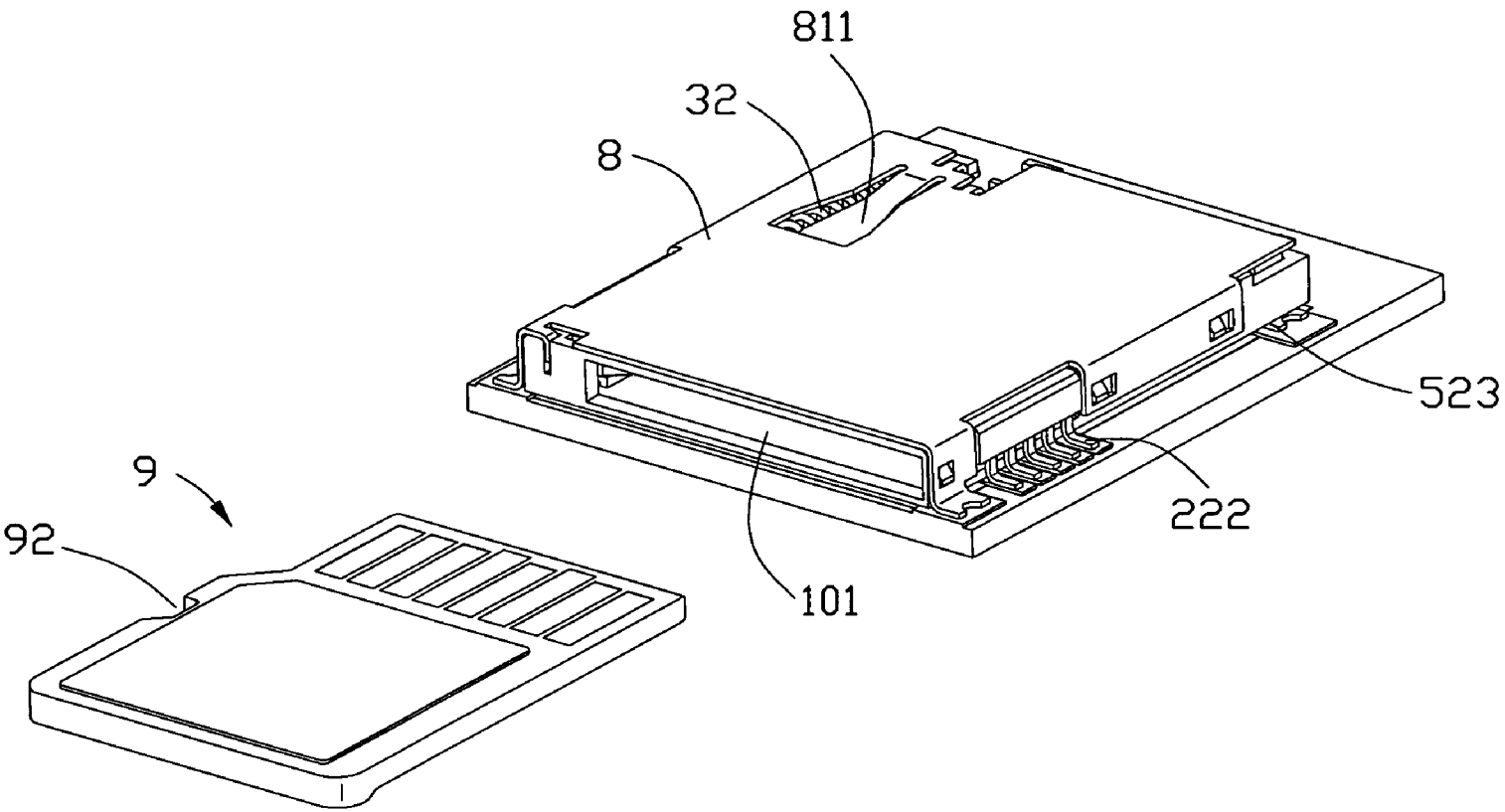
FIG. 8 is a perspective view of the memory card connector mounted on a printed circuit board (PCB) showing a memory card detached from the memory card connector.
Figure 9:
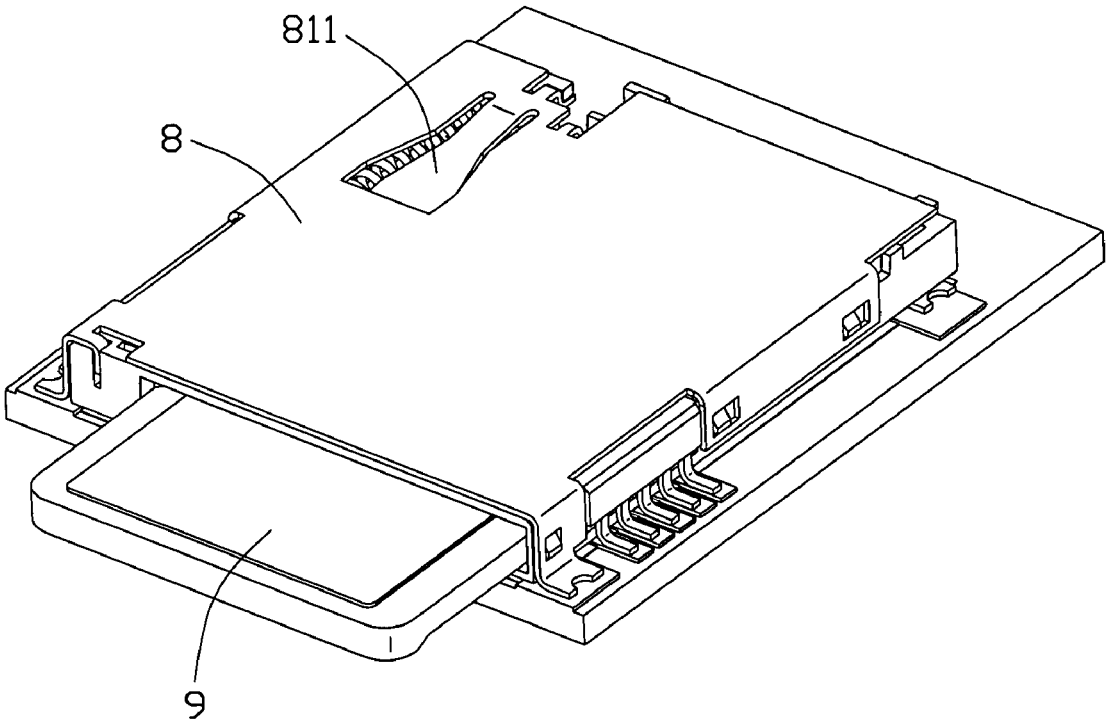
FIG. 9 is a perspective view of the memory card connector mounted on the PCB showing the memory card inserted into the memory card connector.

Referring to FIGS. 8 and 9, in use, when the memory card 9 is inserted into the cavity 110 through the opening 101, the actuation portion 315 is driven by the front edge of the memory card 9. The second contact portion 62 of the elastic member 6 is compressed to connect the second contact section 522 of the second switch contact 52 by means of the front edge of the memory card 9 abutting against the mating block 7. As a result, a switch function is realized. In the process, the coiled spring 32 is compressed and the second hook 333 of the link rod 33 moves in the heart-shaped cam 311 of the slider 31. When the memory card 9 is fully inserted into the memory card connector 100, the second hook 333 reaches a locking position of the heart-shaped cam 311. The locking portion 42 of the card lock member 4 mates with a notch 92 of the memory card 9. As a result, the memory card 9 is stably retained in the memory card connector 100. In this condition, the second contact portion 62 can provide flexible engagement with the second switch contact 52, which can provide the second switch contact 52 from excessive deformation after long time usage. When further exerting a forward force on the fully inserted memory card 9, the memory card 9 and the slider 31 move rearwards. The slider 31 returns to its initiative position via the elastic force recovery of the coiled spring 32. At the same time, the second hook 333 moves from the locking position and the locking portion 42 of the card lock member 4 disengages with the notch 92 of the memory card 9, thereby the memory card 9 is ejected from the memory card connector 100. The second contact portion 62 of the elastic member 6 releases its elastic force to make it disengages from the second contact section 522 so that the first and second switch contacts 51, 52 disengage from each other.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A memory card connector for insertion of a memory card, comprising:

an insulative housing defining a card receiving cavity;

a plurality of contacts with a plurality of contact portions protruding into the card receiving cavity;

a pair of switch contacts retained in the insulative housing; and an elastic member including a first contact portion constantly connecting one switch contact regardless of an insertion of the memory card, and a coiled spring detachably engaging with the other switch contact depending on the insertion of the memory card.

2. The memory card connector according to claim 1, wherein the first contact portion is a coiled spring which always connects the one switch contact.

3. The memory card connector according to claim 1, wherein the first contact portion is parallel to the coiled spring in a card insertion direction.

4. The memory card connector according to claim 1, wherein the insulative housing comprises a projecting block defining an aperture to receive the coiled spring.

5. The memory card connector according to claim 1, wherein the one switch contact comprises a contact section mating with the first contact portion of the elastic member, the other switch contact comprising another contact section detachably engaging with the coiled spring, and wherein the contact sections are in a vertical plane.

6. The memory card connector according to claim 1, wherein the insulative housing comprises a base portion and a frame shaped mating portion at a front of the base portion, the card receiving cavity being defined in the base portion and having an opening which extends through the mating portion.

7. The memory card connector according to claim 1, further comprising a card eject mechanism comprising:

a slider movably assembled to the insulative housing, the slider comprising a body portion and an actuation portion extending from the body portion, the body portion defining a heart-shaped cam, the actuation portion being driven by the memory card;

a coiled spring member with one end abutting against the insulative housing and the other end abutting against the slider; and a link rod comprising one hook retained in the insulative housing and the other hook movable in the heart-shaped cam.

8. The memory card connector according to claim 1, wherein the elastic member comprises a connecting portion connecting the first contact portion and the coiled spring.

9. The memory card connector according to claim 8, wherein the insulative housing comprises an engagement block abutting against the connecting portion.

10. The memory card connector according to claim 1, wherein the coiled spring is driven by the memory card to engage with the other switch contact.

11. The memory card connector according to claim 10, further comprising a mating block inserted into coiled spring to engage with the memory card.

12. The memory card connector according to claim 1, further comprising a beam over-molding the plurality of contacts, the beam being retained to the insulative housing.

13. The memory card connector according to claim 12, wherein the beam comprises a pair of side portions, the insulative housing comprising a pair of side walls defining a pair of cutouts to receive the side portions.

14. The memory card connector according to claim 13, wherein the contacts comprise a plurality of soldering portions extending sidewardly beyond the side portions.

15. A memory card connector assembly comprising:

an insulative housing defining a card receiving cavity;

a plurality of contacts with a plurality of contact portions protruding into the card receiving cavity;

a pair of switch contacts retained in the insulative housing; and an elastic member including a pair of coiled springs linked to each other and respectively aligned with the pair of switch contacts for simultaneous engagement with the corresponding pair of switch contacts, respectively, when the card is inserted into the card receiving cavity while at least one of said pair of coiled springs being disengaged therefrom when the card is withdrawn from the card receiving cavity.

16. The memory card connector assembly according to claim 15, further comprising a beam over-molding the plurality of contacts, the beam being retained to the insulative housing.

17. The memory card connector assembly according to claim 15, further comprising a mating block inserted into one of said pair of coiled springs to engage with the card.

18. A memory card connector for insertion of a memory card, comprising:

an insulative housing defining a card receiving cavity;

a plurality of contacts with a plurality of contact portions protruding into the card receiving cavity;

a pair of switch contacts retained in the insulative housing; and an elastic member including a coiled spring engaging with one of said switch contact when a card is inserted into the card receiving cavity, and another portion linked to the coiled spring and aligned with the other for mechanical and electrical connection therebetween at least when said card is inserted into the card receiving cavity.

19. The memory card connector according to claim 18, further comprising a beam over-molding the plurality of contacts, the beam being retained to the insulative housing.

20. The memory card connector according to claim 18, further comprising a mating block inserted into the coiled spring to engage with the card.

* * * * *